US005324617A

United States Patent [19]

Majima et al.

[11] Patent Number: 5,324,617

[45] Date of Patent: Jun. 28, 1994

[54] PRINTING MATERIAL COMPRISING A COMBUSTIBLE MATERIAL SUITABLE FOR CREATING PITS ON IRRADIATION WITH A LASER BEAM

[75] Inventors: Osamu Majima, Kanagawa; Hiroshi Benno, Chiba, both of Japan

[73] Assignee: Sony Corporation, Tokyo, Japan

[21] Appl. No.: 903,757

[22] Filed: Jun. 25, 1992

[30] Foreign Application Priority Data

Jun. 28, 1991 [JP] Japan ..... 3-185612

[51] Int. Cl.[5] ..... G03C 1/73

[52] U.S. Cl. ..... 430/138; 430/307; 430/495; 430/945; 430/964

[58] Field of Search ..... 430/945, 138, 300, 307, 430/495, 964, 911

[56] References Cited

U.S. PATENT DOCUMENTS

| | | | |
|---|---|---|---|
| 3,787,210 | 1/1974 | Roberts | 430/945 |
| 3,934,503 | 1/1976 | Kinney et al. | 430/308 |
| 3,977,922 | 8/1976 | Inoue et al. | 349/2 |
| 4,060,032 | 11/1977 | Evans | 430/138 |

*Primary Examiner*—Richard L. Schilling
*Assistant Examiner*—John A. McPherson
*Attorney, Agent, or Firm*—Hill, Steadman & Simpson

[57] ABSTRACT

A printing material comprises a shaped structure made of a combustible material and an oxidizing agent, or a self-combustible material having an oxidizing agent contained therein, or a mixture of a self-combustible material and a combustible material. The printing material is formed with pits by application of a laser beam with small output power. The printing material may further comprise a light absorber in order to promote absorption of the laser beam in the printing material.

5 Claims, 2 Drawing Sheets

PRINTING MATERIAL COMPRISING A COMBUSTIBLE MATERIAL SUITABLE FOR CREATING PITS ON IRRADIATION WITH A LASER BEAM

BACKGROUND OF THE INVENTION

1. Field of The Invention

This invention relates to a printing material used for fabricate a printing plate and more particularly, to a printing material which is enabled to make a printing plate by laser engraving.

2. Description of The Prior Art

As is known in the art, printing plates such as for gravure printing are formed of a very large-sized, heavy metal roll. For the fabrication of the printing plate, a specific type of equipment is necessary with a number of complicated plate-making steps. In addition, a skilled technique for the fabrication of the plate is essential.

As a printing material, there have been used resin sheets such as a polyethylene sheet, which are flexible and light in weight. Moreover, the printing material is formed with fine pits by laser processing and, thus, engraving is now automated.

For the engraving of the printing material, the material is initially wound about a plate cylinder of a printing machine. Then, a laser beam emitted from a laser device such as a semiconductor laser is converted into a predetermined spot size by means of a focusing optical system and irradiated on the wound material. Where a plurality of pits are formed on the surface of the material, the plate cylinder is turned while moving the focusing optical system along the length of the cylinder. As a result, the laser beam is irradiated on the surface of the plate material at portions where pits are to be formed, thereby establishing a required number of pits therein. In this manner, a printing plate is obtained.

However, when a semiconductor laser is used to establish pits in the printing material in a manner as stated above, it takes a long time before the pits have been formed only by application of the laser beam. This is because of the low combustibility of the printing material.

SUMMARY OF THE INVENTION

It is accordingly an object of the invention to provide a printing material which has enhanced combustibility when pits are engraved by application of a laser beam.

It is another object of the invention to provide a printing material which is particularly suitable for making a printing plate engraved in a desired pit pattern by irradiation with a laser beam.

The above objects can be achieved, according to the invention, by a printing material which comprises a shaped structure which is made of a combustible material and an oxidizing agent to facilitate combustion of the combustible material. In a more specific and preferable embodiment, there is provided a printing material which comprises a shaped structure which is made of a self-combustible material capable of combustion by the action of an oxidizing agent contained therein. In another preferable embodiment, there is also provided a printing material which comprises a shaped-structure which is made of a self-combustible material capable of combustion by the action of an oxidizing agent contained therein, and a combustible material.

DETAILED DESCRIPTION AND EMBODIMENTS OF THE INVENTION

As defined above, the printing material of the invention is made of a combustible material containing an oxidizing agent, or a self-combustible material, or a mixture of a self-combustible material and a combustible material. When a laser beam with a small energy is applied, the printing material readily undergoes combustion with the aid of the oxidizing agent contained therein at portions where irradiated with the laser beam. The portions are removed, for example, by evaporation thereby forming a pit.

Figure 1:
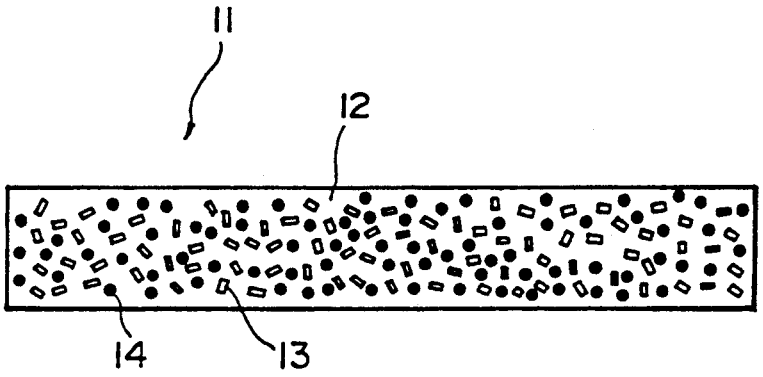
FIG. 1 is a schematic sectional view of a printing plate according to one embodiment of the invention.

Reference is now made to the accompanying drawings and particularly, to FIG. 1 wherein one embodiment of the invention is shown.

In the figure, there is shown a printing material 11 which is in the form of a sheet and is made of a mixture of a combustible material 12 and an oxidizing agent 13 kneaded together. The combustible material 12 is able to undergo burning reaction with the oxidizing agent such as, for example, oxygen, chlorate compounds, nitrate compound and the like.

The combustible material 12 is, for example, ethylene-vinyl acetate copolymer and ammonium nitrate is, for example, used as the oxidizing agent. If necessary, a light absorber 14 may be added in order to enhance absorption of a laser beam. Such a light absorber may be a carbon powder such as carbon black. These ingredients are mixed at ratios by weight, for example, of 75% of the ethylene-vinyl acetate copolymer, 10% of ammonium nitrate and 15% of the carbon powder. As a matter of course, the mixing ratios may vary depending on the irradiation energy of a laser beam which is applied to the printing material 11, the wavelength of the laser beam, and the irradiation time of the laser beam.

Fabrication of the printing material 11 is described.

Carbon powder is kneaded with ethylene-vinyl acetate copolymer by the use of a mixing roll unit under kneading conditions, for example, of 100° C. and 10 minutes, thereby obtaining a master batch containing the carbon powder. Likewise, ammonium nitrate is kneaded with ethylene-vinyl acetate copolymer to obtain a master batch containing the ammonium nitrate. The master batches are again kneaded under similar kneading conditions so that the mixing ratios of the respective ingredients are attained.

Subsequently, the resulting mixture is heated to 120° C. and shaped in the form of a sheet by the use of an extruder, thereby forming the printing material 11.

According to the master batch process set out above, it becomes possible to safely knead highly combustible ammonium nitrate and carbon powder with the ethylene-vinyl acetate copolymer.

Aside from the ethylene-vinyl acetate copolymer, there may be used as the combustible material 12 thermosetting resins such as unsaturated polyester resins, epoxy resins, allyl resins, polyurethane resins, and the like, and thermoplastic including hydrocarbon resins such as resins such as polyethylene, polypropylene, polybutene, polystyrene, polybutadiene and the like, polar vinyl resins such as polyvinyl acetate, methyl methacrylate resins and the like, resins with a cotton-like structure such as polyacetals, polycarbonates, polyethylene terephthalate and the like, and rubber resins such as natural rubber, butadiene-based synthetic rubbers and the like.

The oxidizing agent 13 includes, aside from ammonium nitrate, potassium nitrate, potassium perchlorate and the like.

The printing material 11 illustrated in the above embodiment is illustrated as including carbon powder as the light absorber 14. If the combustible material 12 has a good absorption of a laser beam, it is not necessary to add any light absorber 14.

Figure 2:
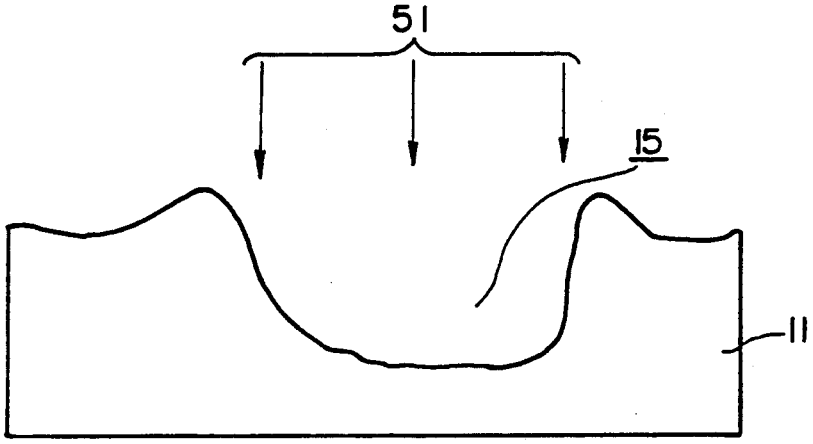
FIG. 2 is a schematic sectional view of a pit formed by laser processing.

Reference is made to FIG. 2 to illustrate irradiation of a laser beam on the sheet-shaped printing material to form pits in which an ink is placed on printing.

A laser beam 51 is, for example, a semiconductor laser beam with a wavelength, for example, of 800 nm. The laser beam emitted from a semiconductor laser device (not shown) is shaped in given mode and given spot size through a focusing optical system (not shown), followed by irradiation on the printing material 11.

At a portion of the printing material 11 where irradiated with laser beam 51, the combustible material 12 is heated by means of the laser beam and vaporized whereupon the combustible material and the oxidizing agent are reacted with each other, facilitating the material 12 to be burnt. The burning is further promoted with the heat generated from the light absorber after absorption of the laser beam. As a consequence, a pit 15 is formed. The pit 15 ordinarily formed by the laser processing has a diameter of several micrometers to several tens micrometers with a depth of several micrometers to several tens micrometers.

In general, if the irradiation energy of the laser beam is too great, splashes are scattered about the pit 15. In the practice of the invention, the pit formation through the laser processing should be effected that there is irradiated a laser beam with a quantity of energy sufficient to form the pit only by evaporation.

In the practice of the invention, the combustible material may be liquefied to obtain a solution, to which an oxidizing agent is added. The liquid mixture is applied onto a substrate (not shown) and solidified to form a thin film made of the combustible material and the oxidizing agent on the substrate. This may be used as a printing material. For the liquefaction, the combustible material may be dissolved in solvents or may be heated to melt. In this case, carbon powder may be added to the solvent or combustible material.

Figure 3:
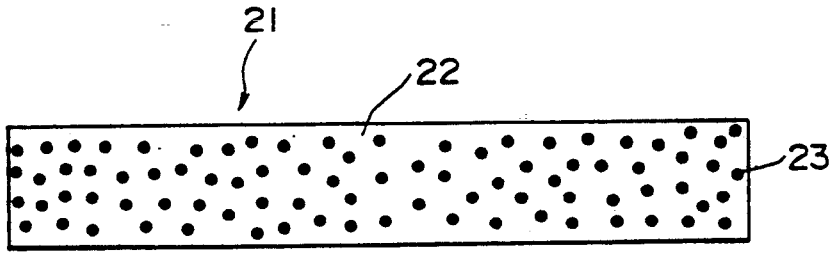
FIG. 3 is a schematic sectional view of a printing plate according to another embodiment of the invention.

Reference is then made to FIG. 3 which illustrates a printing material made of a self-combustible material capable of being burnt by the action of an oxidizing agent contained therein.

As shown in FIG. 3, a printing material 21 is made of a sheet-shaped self-combustible material 22 such as, for example, a film-forming nitro compound such as celluloid (cellulose nitrate), or nitro cellulose. The self-combustible material 22 may contain an appropriate amount of a light absorber 23 in order to ensure good absorption of a laser beam. With carbon powder, the amount is in the range of from 5 to 40% by weight.

The self-combustible material 22 may be formed as a thin film on a substrate (not shown) to obtain a printing material. In this case, an appropriate amount of carbon powder may be added. The combustibility of the material 22 may be properly controlled by controlling the degree of nitration of the nitro compound.

Fabrication of the printing material 21 is described.

Where nitro cellulose is used, for example, as the self-combustible material 22, the nitro cellulose is dissolved in an acetic ester such as isoamyl acetate having a boiling point of 142° C. or ethyl acetate having a boiling point of 76.8° C. After dispersion of from 5 to 40% by weight of a carbon powder as the light absorber 23, the solution is dried to obtain a sheet.

Alternatively, the solution may be applied onto a substrate (not shown) which is a part of the printing material 21 in a thickness of several micrometers to several tens micrometers, followed by drying to form a nitro cellulose thin film having the carbon powder dispersed therein.

In the above embodiment, the carbon powder is added as the light absorber, but if the self-combustible material 22 is a good absorber of the laser beam, no additional light absorber is necessary.

Figure 4:
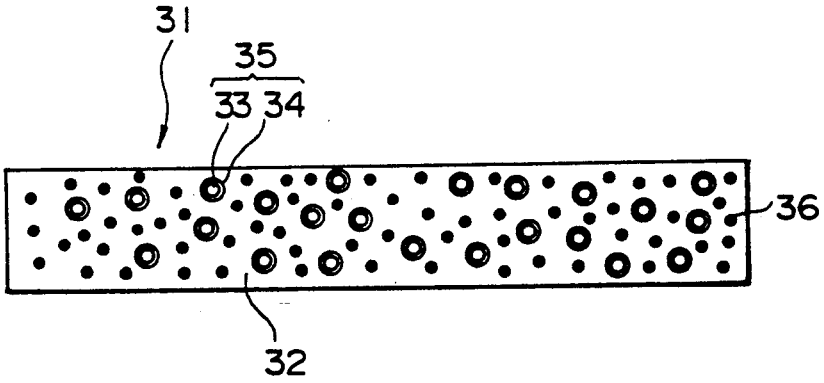
FIG. 4 is a schematic sectional view of a printing plate according to a further embodiment of the invention.

In FIG. 4, there is shown a printing material which is made of a combustible material and a self-combustible material having an oxidizing agent contained therein according to a further embodiment of the invention.

As shown in the figure, a printing material 31 is in the form of a sheet which is formed by mixing a combustible material 32, such as a polyethylene resin, with microcapsules 35 which are made of a self-combustible material 33 surrounded with a thin resin film 34 made, for example, of polystyrene and a light absorber 36 which facilitates absorption of a laser beam. The self-combustible material is, for example, nitro cellulose in the form of particles. The light absorber is made of a carbon powder.

The mixing ratios of these ingredients are, for example, 75% of a polyethylene resin, 8% of microcapsules of nitro cellulose, and 17% of carbon powder. The mixing ratios may be changed depending on the irradiation energy of a laser beams with which the printing material 31 is irradiated, and the irradiation time and wavelength of the laser beam.

Fabrication of the printing material 31 is described.

A given amount of the polyethylene resin is first melted, to which the carbon powder is added for kneading to obtain a master batch. Likewise, the reminder of the polyethylene resin is melted, to which microcapsulated nitro cellulose particles are added for kneading to obtain a master batch. The respective master batches are again kneaded in the same manner as set out above.

The kneaded product is shaped into a sheet to obtain the printing material 31.

The combustible materials 32 include, aside from the polyethylene resin, thermosetting resins, and thermoplastic resins such as hydrocarbon resins, polar vinyl resins, resins with a cotton-like structure, cellulose resins, rubbers and the like as used in the first embodiment.

The self-combustible material 33 includes, aside from nitro cellulose, cellulose resins such as 2,4,6-trinitrophenol, celluloid and the like.

The printing material 31 contains the carbon powder as the light absorber 36. Like the first and second embodiments, if the combustible material 32 or self-combustible material is a good absorber of a laser beam, addition of any light absorber is not necessary.

The printing material 31 may comprise an oxidizing agent as illustrated with respect to the first embodiment.

Another type of printing material using a combustible material and a self-combustible material is described.

A combustible material and a self-combustible material are, respectively, dissolved in solvents and the resultant solutions are mixed together. The printing material 31 is obtained by applying and drying the mixture on a substrate.

For instance, there are used polyvinyl alcohol as the combustible material and nitro cellulose as the self-combustible material.

The polyvinyl alcohol is dissolved in an alcohol solvent. The nitro cellulose is dissolved in the alcohol solvent. The resultant solutions are mixed together. The mixture is applied onto a resin or metal substrate and dried to obtain a printing material made of a dispersion of the nitro cellulose in the polyvinyl alcohol.

As stated hereinabove, the printing materials according to the embodiments of the invention are formed of a combustible material and an oxidizing agent, or a self-combustible material, or a mixture of a combustible material and a self-combustible material. Accordingly, the printing material is high in combustibility. Even if the energy of a laser beam is small, pit formation becomes easy, permitting a multitude of pits to be readily formed in the surface of the printing material within a short time.

What is claimed is:

1. A printing material, comprising a shaped structure which is made of a dispersion of a self-combustible material in a combustible material, wherein the self-combustible material is in the form of microcapsules encapsulated with a resin film, said self-combustible material consisting essentially of a film-forming nitro compound.

2. A printing material according to claim 1, wherein said shaped structure is in the form of a sheet.

3. A printing material according to claim 1, further comprising a sheet-shaped substrate on which the shaped structure is formed as a thin film.

4. A printing material according to claim 3, further comprising a light absorber in the thin film.

5. A printing material according to claim 1, further comprising a light absorber in the shaped structure.

* * * * *